US007341220B2

(12) United States Patent
Katayama

(10) Patent No.: US 7,341,220 B2
(45) Date of Patent: Mar. 11, 2008

(54) ROLL SUPPORT MEMBER AND RECORDING MATERIAL PACKAGE EMPLOYING SAME

(75) Inventor: Masaya Katayama, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 189 days.

(21) Appl. No.: 10/743,869

(22) Filed: Dec. 24, 2003

(65) Prior Publication Data

US 2004/0134820 A1 Jul. 15, 2004

(30) Foreign Application Priority Data

Dec. 27, 2002 (JP) ..... 2002-379140
Jul. 18, 2003 (JP) ..... 2003-276495

(51) Int. Cl.
*B65H 75/12* (2006.01)

(52) U.S. Cl. ..... 242/614; 242/614.1; 206/416

(58) Field of Classification Search ..... 242/614, 242/614.1; 206/414, 415, 416
See application file for complete search history.

(56) References Cited

U.S. PATENT DOCUMENTS 3,260,362 A 7/1966 Schwinne
4,657,203 A * 4/1987 Crawford ..... 242/125.1
5,205,411 A 4/1993 Oberhausen et al.
6,048,676 A 4/2000 De Leener et al.

FOREIGN PATENT DOCUMENTS

JP 07-330032 A 12/1995
JP 11-327089 A 11/1999
JP 2002-244249 A 8/2002

* cited by examiner

*Primary Examiner*—John Q. Nguyen
(74) *Attorney, Agent, or Firm*—Sughrue Mion, PLLC

(57) ABSTRACT

A roll support member is provided that is used for suspending in a packaging case a roll-form recording material wound around a core. The roll support member includes a four corner-cut square flange portion having a thickness and an insertion portion that projects cylindrically from substantially the center of the flange portion and is inserted into one end of the core. The flange portion and the insertion portion are formed integrally. The side of the flange portion from which the insertion portion projects is a flat face. The side of the flange portion opposite to the flat face is provided with ribs forming a plurality of energy absorbing space zones. The outer peripheral side of the flange portion has a height that is no greater than the height of the ribs. There is also provided a recording material package in which a roll-form recording material is suspended and supported in a housing by the roll support members.

7 Claims, 12 Drawing Sheets

ROLL SUPPORT MEMBER AND RECORDING MATERIAL PACKAGE EMPLOYING SAME

BACKGROUND OF THE INVENTION

1. Field of the Invention

The present invention relates to a roll support member for suspending and supporting a roll-form recording material in a housing, and also relates to a recording material package employing the roll support member.

2. Description of the Related Art

In general, a roll-form recording material is stored and transported as a package in which the roll-form recording material is supported and suspended by roll support members and housed in a housing. In the case of a light-sensitive recording material, the recording material is completely shielded from light by covering it with a light-shielding flange and a light-shielding leader and then housed in the housing. Regardless of whether it is light-sensitive or non-light-sensitive, with regard to roll support members for suspending and fixing the roll-form recording material in a housing by means of cushioning members, those comprising two members, that is, a cylindrical shaft and a flange portion, are used. In this case, the cylindrical shaft is inserted through a hole of the flange portion and further inserted into either end of a core around which the roll-form recording material is wound, thus suspending and supporting the roll-form recording material in the housing.

However, the above-mentioned structure having the flange portion at the end of the cylindrical shaft has the problem that it is susceptible to an impact received when the housing is dropped, etc. Because of this, a comparatively thick molding formed from a thermoplastic resin such as polyethylene, which is resistant to deformation, has been used as a material for the roll support member. However, a thick molding has the defects that the amount of material used is large, the cooling time during molding is long, etc. Furthermore, the roll support member comprising two members, that is, the cylindrical shaft and the flange portion, is expensive to produce.

A roll support member in which a flange portion and a cylindrical shaft for supporting a roll-form recording material are formed integrally has been disclosed (ref. JP-A-11-327089, JP-A-7-330032, and JP-A-2002-244249 [JP-A denotes a Japanese unexamined patent application publication]). However, the strength toward a drop impact is insufficient, and there has been a desire for further improvement.

Furthermore, even when the roll support member formed integrally from the cylindrical shaft and the flange portion is employed, in the case of the light-sensitive recording material, a light-shielding flange is often used at each of the end faces of the recording material roll, but there is a desire for a roll support member that will not cause any indentation on the outer periphery of a recording material roll even if a light-shielding flange is not used at each of the end faces of the roll.

BRIEF SUMMARY OF THE INVENTION

An object of the present invention is to provide a roll support member having a structure that has excellent manufacturability, can be molded thin even using a resin having relatively low strength, and is highly resistant to an impact of being dropped, etc. Another additional object of the present invention is to provide a roll support member that enables discrimination of the product type to be automated in multi-product production by automatic reading by means of a production machine and. Yet another object of the present invention is to provide a recording material package by employing the above roll support member, the roll-form recording material being resistant to deformation due to an impact when the package is dropped, and the package being suitable for multi-product production.

The above-mentioned objects of the present invention can be achieved by a roll support member that is used for suspending in a packaging case a roll-form recording material wound around a core, the roll support member comprising a four corner-cut square flange portion having a thickness and an insertion portion that projects cylindrically from substantially the center of the flange portion and is inserted into one end of the core, the flange portion and the insertion portion being formed integrally, the side of the flange portion from which the insertion portion projects being a flat face, the side of the flange portion opposite to the flat face being provided with ribs forming a plurality of energy absorbing space zones, and the outer peripheral side of the flange portion having a height that is no greater than the height of the ribs; and a recording material package in which a roll-form recording material is suspended and supported in a housing by the roll support member.

DETAILED DESCRIPTION OF THE INVENTION

Modes for carrying out the present invention are explained below with reference to the figures, but the present invention is not limited thereto.

Figure 1:
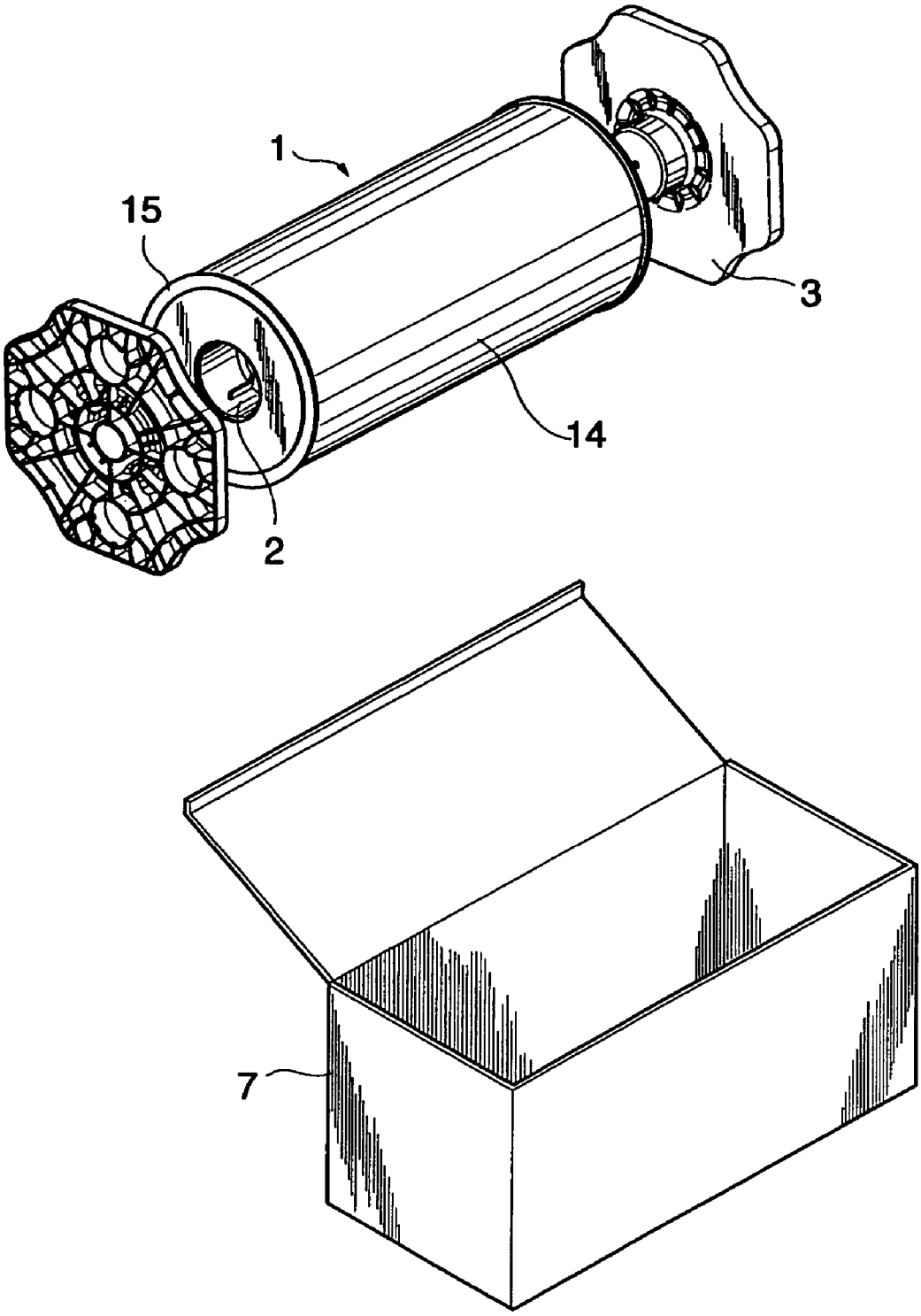
FIG. 1 is a schematic perspective view of each member when a roll-form recording material having a roll support member as one embodiment of the present invention mounted on each end thereof is housed in a case.

FIG. 1 is a schematic perspective view of each member when a roll-form recording material having a roll support member as one embodiment of the present invention mounted on each end thereof is housed in a case. In FIG. 1, a roll-form recording material 1 wound around a core 2 is wrapped with a light-shielding leader 14 and a light-shielding flange 15. Roll support members 3, which comprise a flange portion and an insertion portion that is to be inserted into either end of the roll-form recording material 1, are preferably made by injection molding. A case 7 is a housing for the roll-form recording material 1. The roll support members 3, which engage with the core 2 around which the roll-form recording material 1 is wound so as to suspend and support it, are mounted at opposite ends of the recording material roll. The roll-form recording material 1 is suspended and supported by the roll support members 3, housed and sealed in the rectangular parallelepiped case 7, and then stored and transported. The roll support member 3 has dimensions that fit exactly in the opposite side faces of the rectangular parallelepiped case 7. The rectangular parallelepiped has a width that can house without any gap the roll-form recording material 1 having the roll support members 3 engaged therewith.

The roll support members 3 are used as energy absorbing support members for protecting the roll-form recording material wound around the core from an impact of being dropped, etc.

The roll-form recording material that can be used in the present invention is a recording material in a state in which a long length of wide recording material is wound around a core in roll form. The width and the length of the long length of wide recording material are not particularly limited but, in general, its width is 100 to 1,500 mm and its length is 10 to 200 m and, for example, the width is 152 mm, 610 mm, 864 mm, 1213 mm, etc. and the length is about 30 to 130 m. It is of course possible for the width and the length to be larger than the above. The type of roll-form recording material referred to in the present invention is not particularly limited and can include all types of image recording materials such as light-sensitive materials used for photography, printing, photocopying, etc. and color copier image receiving paper. The light-sensitive material is not limited to a silver halide light-sensitive material employing a light-sensitive silver halide (including a heat-developable light-sensitive material) and various types of light-sensitive material film having a light-sensitive element other than silver halide and printing paper having a paper support covered with a polyolefin resin are all included.

One embodiment of the present invention is explained with reference to FIGS. 2 to 4.

Figure 2:
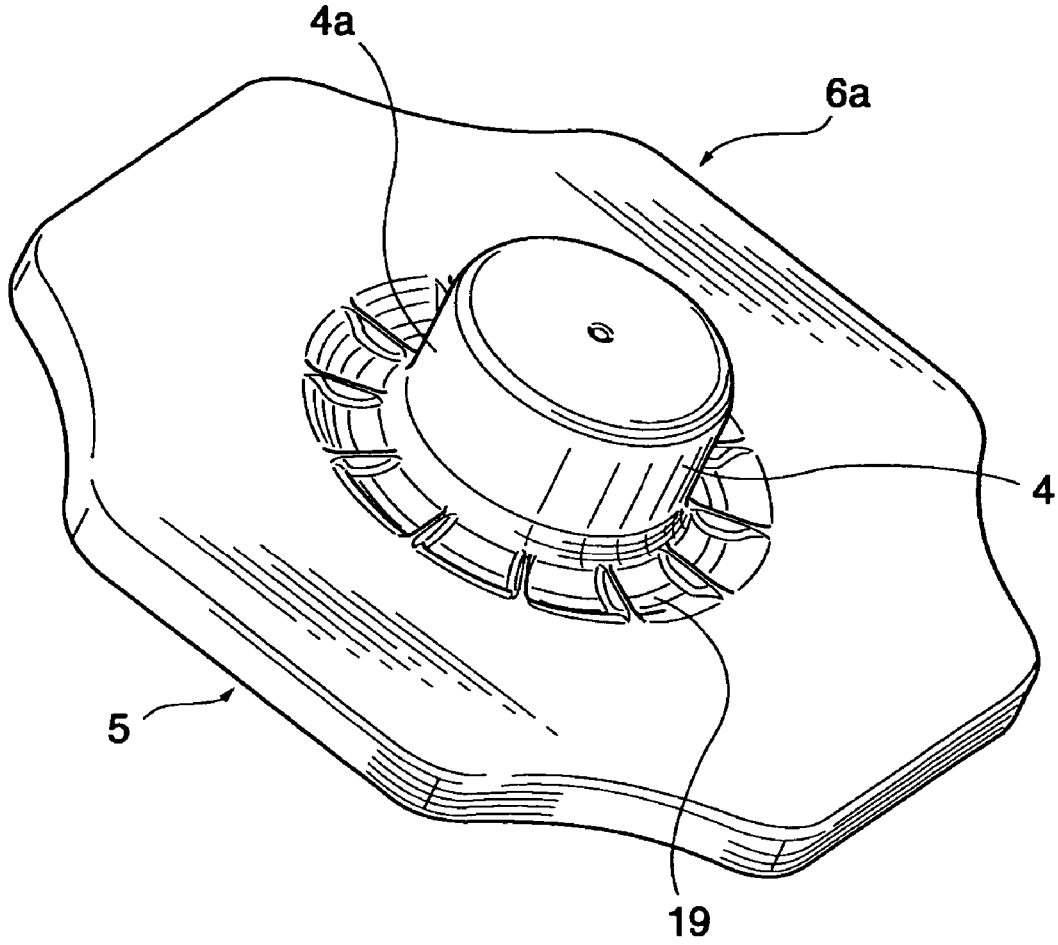
FIG. 2 is a schematic perspective view showing a first side (flat face) 6*a* of a flange portion of the embodiment of the present invention.

FIG. 2 shows a first side (flat face) 6*a* of the flange portion as one embodiment from which an insertion portion 4 projects.

Figure 3:
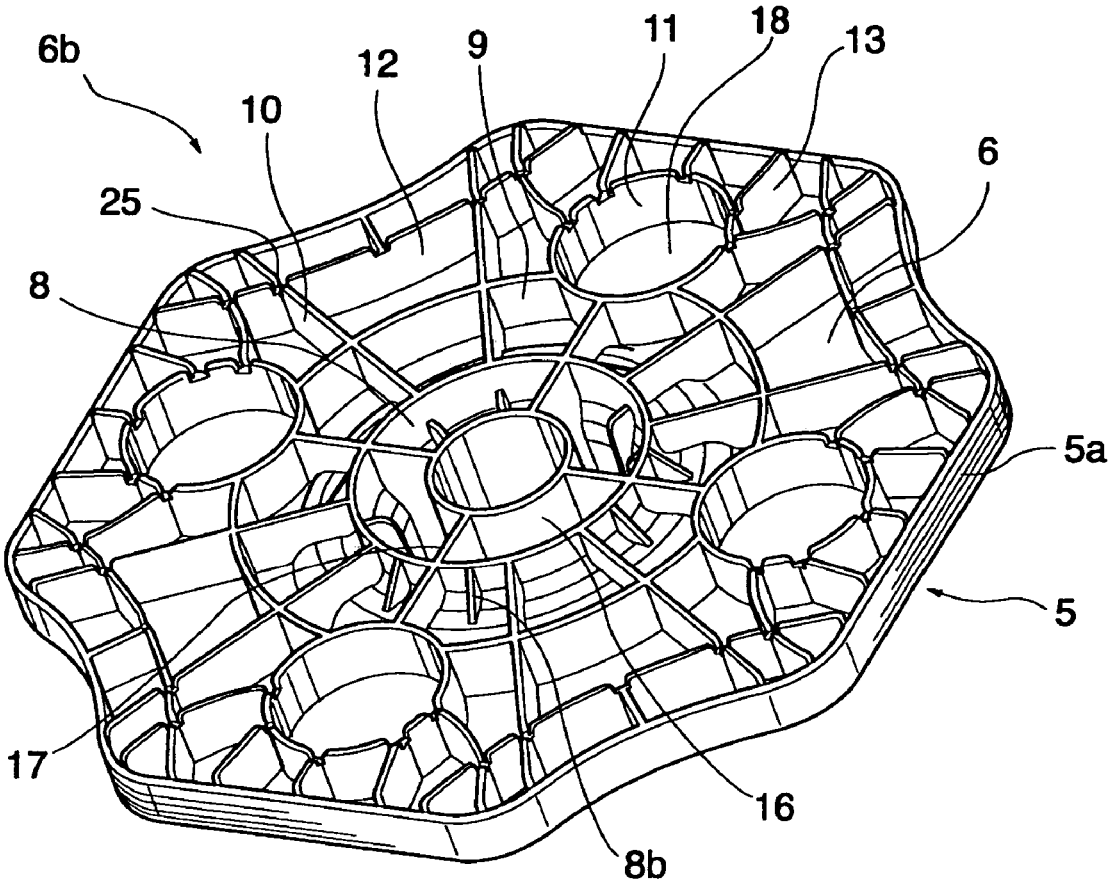
FIG. 3 is a schematic perspective view showing a second side (opposite side) opposite to the flat face of the flange portion of the embodiment of the present invention.
Figure 4:
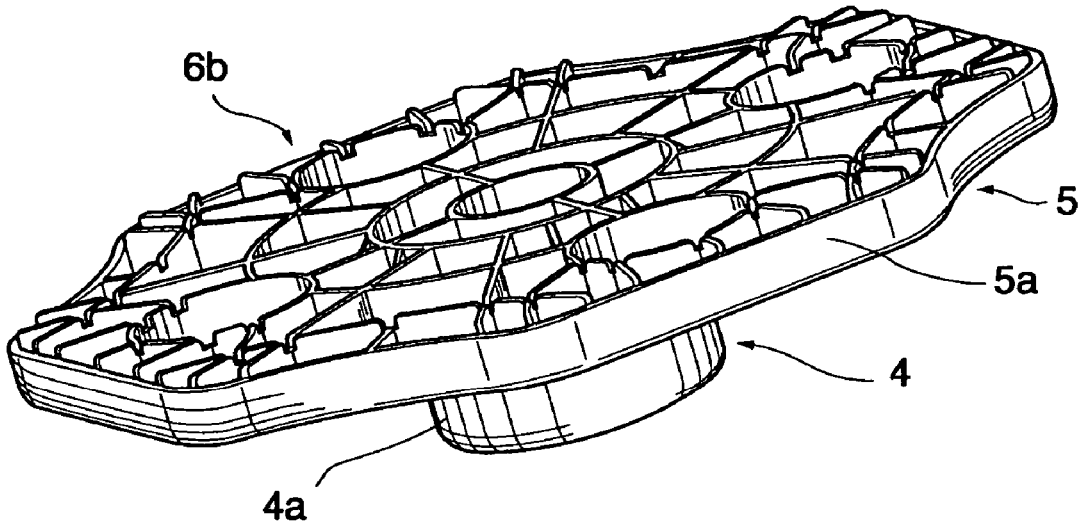
FIG. 4 is a schematic perspective view showing the roll support member of the embodiment of the present invention.

FIG. 3 and FIG. 4 show a second side (opposite side) 6*b* that is opposite to the flat face 6*a*, and that comprises ribs forming energy absorbing space zones of the flange portion 5 as one embodiment. The flange portion 5 comprises a four corner-cut square flange plate 6, an outer peripheral side 5*a*, and the ribs, which will be described later.

The flange portion 5 of the roll support member 3 preferably has a shape that is basically a square in order to minimize the size of the case 7 housing the roll-form recording material 1 into which the roll support members 3 have been inserted, and is a four corner-cut square in the present invention. The four corner-cut square can be any shape, and there can be cited specifically a substantially octagonal shape, a regular octagonal shape, and a shape as shown in FIG. 2 in which 4 non-adjacent sides of an octagonal shape are curved toward the center of the octagon in a concave shape. In any of the shapes, the outer periphery of the flange plate 6 preferably has rounded corners, and specifically in the case of an octagonal shape the corners formed between adjacent sides are preferably rounded.

The dimensions of the four corner-cut square flange portion 5 can be varied appropriately depending on the length of the recording material that is wound around the core 2.

In FIG. 2, the cylindrical insertion portion 4 is attached integrally to the flat face 6*a* of the flange portion 5. The extremity of the insertion portion 4 may be closed or open. The roll support member of FIG. 2 has an insertion portion having the extremity thereof closed as one example of the present invention. By inserting the insertion portion 4 into a hollow portion of the core 2 at either end of the roll-form recording material 1 and making the outer peripheral face 4*a* of the insertion portion come into intimate contact with the inner peripheral face of the core 2, it is possible to prevent pressure from outside the package and deformation of the core as a result of dropping or vibration during transport.

As shown in FIG. 3, the insertion portion has a hollow inner portion, and it is preferable to provide the hollow inner portion with a cylindrical rib 16 disposed in a cylindrical shape that is substantially concentric with the insertion portion, and radial ribs 17 that are disposed so as to provide a connection between the concentric cylindrical rib and the face of the insertion portion on the hollow inner portion side.

The heights of the cylindrical rib 16 and the radial ribs 17 can be the same as the height of a cylindrical rib 8, and can be shorter than the height of the cylindrical rib 8 in order to increase the amount of overlap when the roll support members 3 are stacked by engagement of the insertion portion 4 and stored.

Figure 7:
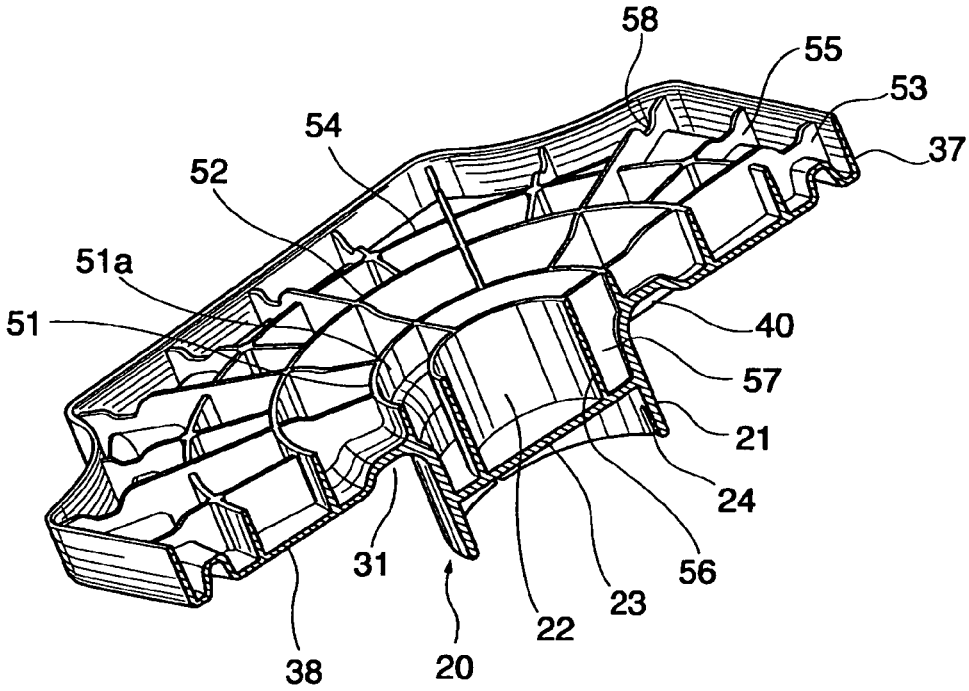
FIG. 7 is a schematic cross sectional perspective view along line A-A' of FIG. 6.

Ribs provided in the hollow inner portion of the insertion portion are explained further in detail in an embodiment shown in FIG. 7.

As shown in FIG. 2, it is preferable to provide a depression 19 around the insertion portion 4 in a section in which the insertion portion 4 and the flange plate 6 forming the flange portion intersect. The shape of the depression 19 will be explained in detail in an embodiment shown in FIG. 5.

In FIG. 3 and FIG. 4, the roll support member 3 has an outer peripheral side 5*a* rising from each side of the flange plate 6, which forms the flange portion 5, in a direction opposite to that in which the insertion portion 4 is formed. The outer peripheral side 5*a* and the flange plate 6 are formed integrally. It is preferable for the corner formed between the outer peripheral side 5*a* and the flange plate 6 to be rounded.

The height of the outer peripheral side 5*a* is no greater than the height of the ribs forming the energy absorbing space zones.

Ribs forming a plurality of energy absorbing zones provided on the second side (opposite side) opposite to the flat face of the flange portion are now explained with reference to FIG. 3 and FIG. 4.

In FIG. 3, the cylindrical rib 8 is a rib that is provided integrally with the flange plate 6 forming the flange portion on the second side (opposite side) 6*b* that is opposite to the first side (flat face) 6*a* of the flange plate 6. The cylindrical rib 8 is a cylindrical rib that is concentric with the insertion portion 4 and has an inner peripheral face that fits, with play, around the outer peripheral face 4*a* of the insertion portion 4.

The outer periphery of the cylindrical rib 8 is preferably provided with ribs 8*b*. The ribs 8*b* are formed radially, with the cylindrical rib 8 as the center, and are formed integrally with the cylindrical rib 8 and the flange plate 6.

A cylindrical rib 9 is a cylindrical rib that is concentric with the insertion portion 4, the cylindrical rib 9 being provided integrally with the flange plate 6 on the second side (opposite side) 6*b* that is opposite to the first side (flat face) 6*a* of the flange plate 6 forming the flange portion. The cylindrical rib 9 is provided between the outer peripheral side 5*a* and the cylindrical rib 8.

Radial ribs 10 are ribs that are disposed radially with the cylindrical rib 8 as the center so as to provide a connection between the cylindrical rib 8 and the outer peripheral side 5*a*, and the radial ribs 10 are provided integrally with the plate 6 forming the flange portion, the cylindrical rib 8, the cylindrical rib 9, and the outer peripheral face 5*a*.

In FIG. 3, a cylindrical rib 11 can be provided between the cylindrical rib 8 and the outer peripheral side 5*a*. An area on the side 6*b* opposite to the flat face 6*a* of the flange portion surrounded by the cylindrical rib 11 is circular, and it is possible to make a suction pad become attached to the circular face 18. That is, it becomes possible to handle the roll support member 3 using the suction pad, and the workability when preparing a recording material package is made excellent.

A rib 12 is a rib that is provided along a curved side of the octagonal plate 6 forming the flange portion 5. Furthermore, a plurality of ribs 13 may be provided between the outer peripheral side 5*a* and the cylindrical rib 11. The ribs 11 to 13 are formed integrally with the flange plate 6 forming the flange portion and other ribs that intersect the ribs 11 to 13.

A plurality of ribs other than the above-mentioned ribs can be provided in the present invention.

In the embodiment shown in FIG. 3, it is preferable for there to be notches 25 at positions where the energy absorbing zone-forming ribs intersect each other. The depth of the notch is preferably 10% to 100% of the height of the rib. Although it is possible to provide the notches at any position where the ribs intersect, it is preferable for them to be provided in the outer peripheral part of the flange portion 5. More specifically, they are provided at positions where the radial ribs 10 and the rib 12 intersect each other, at positions where the cylindrical rib 11 and the ribs 13 intersect each other, etc. Since the ribs break at the notch area, an impact that is imposed on the outermost energy absorbing space zone of the flange portion when dropped, etc. will disappear without being transmitted to a second energy absorbing space zone. From the viewpoint of maintaining the shape of the roll support member 3 without breaking the flange plate 6 forming the flange portion 5, the insertion portion 4, etc., it is preferable to provide the notches 25 in order to make the ribs easy to break.

Notches can also be provided on the outer periphery of the extremity portion of the insertion portion. It is preferable to provide notches at positions where they can engage with the radial ribs 17. Providing notches makes the stacking positioning easy when the roll support members 3 are stacked and stored, and is effective for improving the stacking properties.

Another embodiment of the present invention is now explained with reference to FIGS. 5 to 8.

Figure 5:
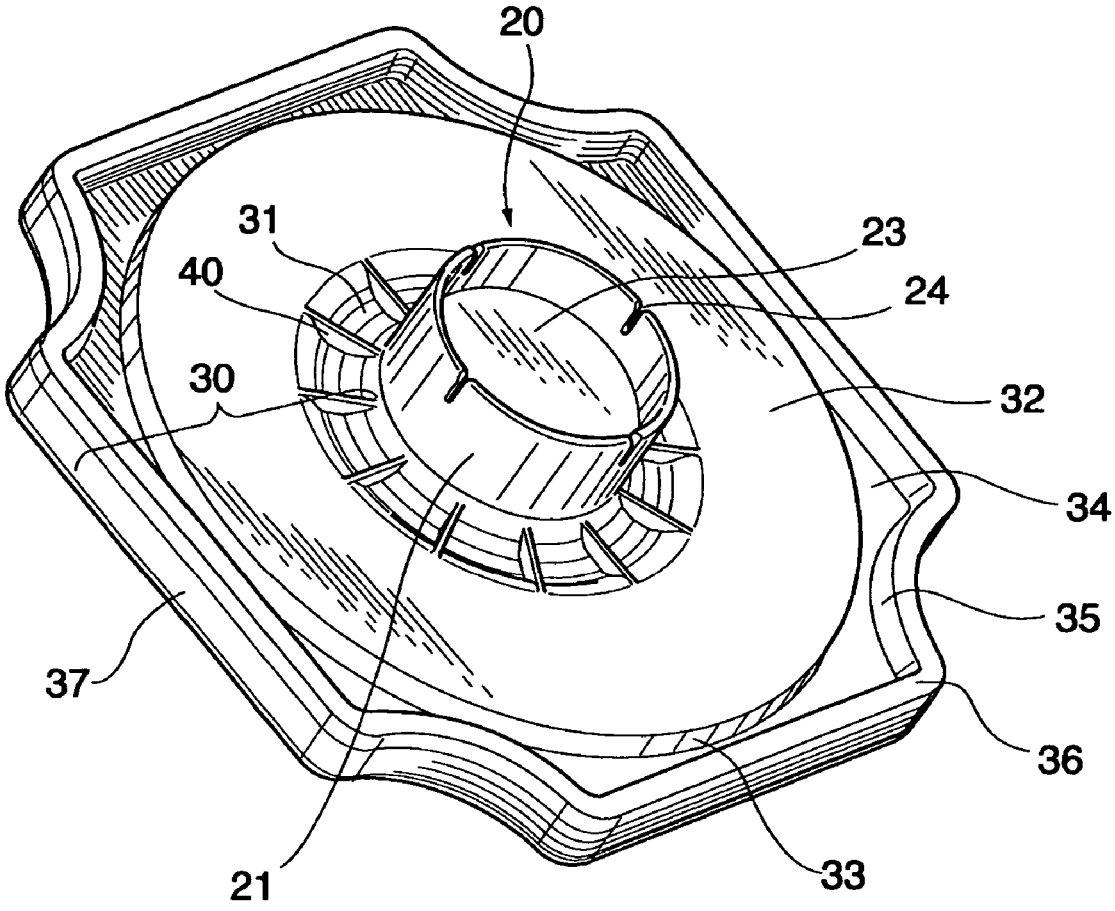
FIG. 5 is a schematic perspective view from the first side (flat face) of the roll support member of one embodiment of the present invention.

FIG. 5 is a schematic perspective view from a first side (flat face) 32 side of another embodiment of the roll support member 3 of the present invention.

Figure 6:
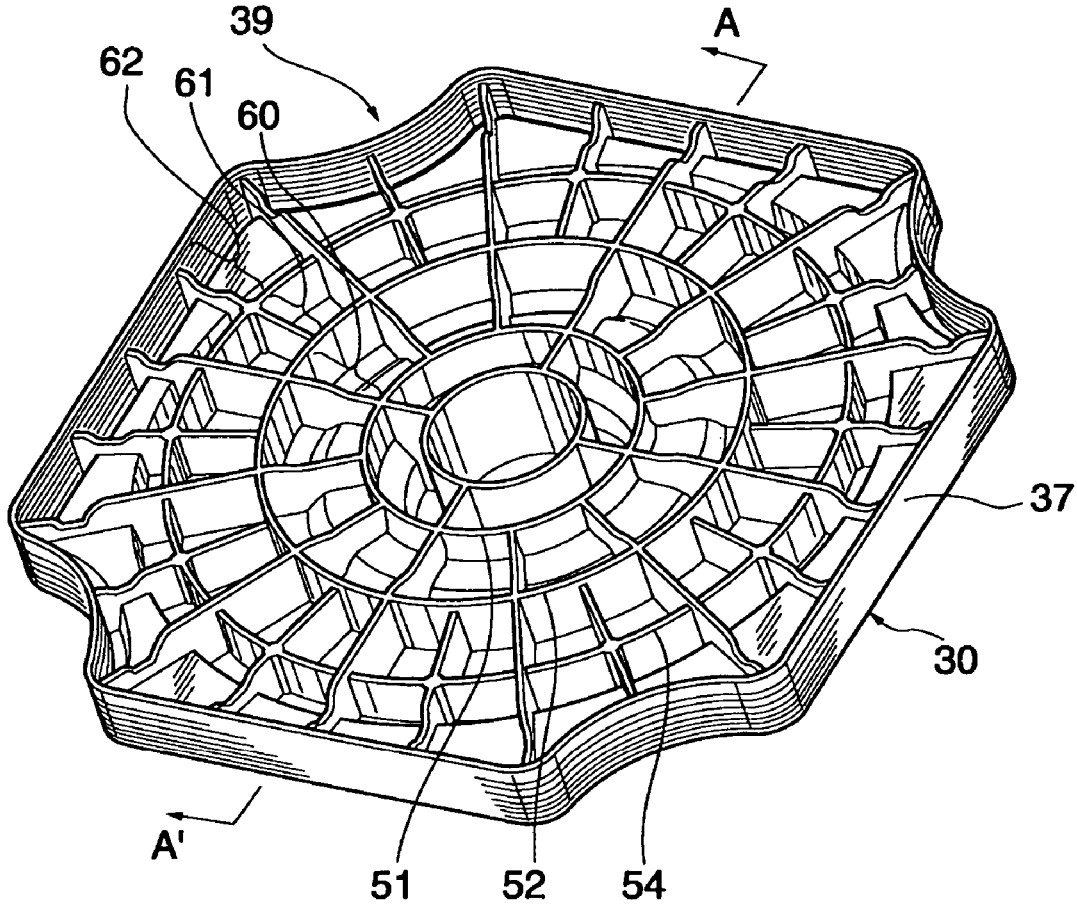
FIG. 6 is a schematic perspective view from the second side (opposite side) of the roll support member of the embodiment of the present invention.

The roll support member has a first side (flat face) 32, and a second side (opposite side) 39 that is opposite to the first side, and FIG. 6 is a perspective view of the roll support member 3 from the opposite side 39.

As shown in FIG. 5, the roll support member 3 is molded integrally from an insertion portion 20 and a flange portion 30 connected thereto. The insertion portion 20, which engages with one end of the core 2, is provided at substantially the center of the flange portion 30. The insertion portion 20 may be open, but it is preferable for the insertion portion to be closed in a middle section thereof.

The flange portion 30 has a flange plate having a four corner-cut square shape, and an outer peripheral side 37. When the flange plate cited as an example is viewed from the flat face side, it is formed from, going from the insertion portion side in sequence, a depression 31, an annular band-shaped flat face 32, a channel 34, and a rim portion 36. The outside of the rim portion forms the outer peripheral side 37, and the outer peripheral side 37 has a substantially constant height around its circumference.

The insertion portion 20 and the flange portion 30 are connected together by the flange plate having the depression 31, which is provided in an annular shape around the insertion portion 20 and is a curved surface having a U-shaped cross section, and the outer side of the depression 31 is the annular band-shaped flat face 32.

The cross section of the depression 31 is preferably semicircular having an appropriate curvature, and the radius of curvature r of the cross section of the depression is preferably 1 to 10 mm. This depression 31 is provided in order to prevent any damage being caused, in a section of the roll support member 3 where the flange portion 30 and the insertion portion 20 are connected, by an impact when the recording material package is dropped. The border between the depression 31 and the flat face 32 of the flange portion 30 is preferably rounded without edges. It is preferable to provide radial ribs 40 in the radial direction within the depression 31, and the height of the ribs is kept at the level of the flat face 32 or below. The radial ribs 40 within the depression are formed integrally with the depression 31. The number of radial ribs is 4 to 16, and preferably 8 or 12.

The annular band-shaped flat face 32 is a flat face present in a region surrounded by two concentric circles having different diameters, protects opposite end faces of the recording material roll when the roll support members 3 are engaged with the core of the recording material roll, and prevents the recording material roll from telescoping in the axial direction. The outer diameter of the annular band-shaped flat face 32 is preferably set so as to coincide approximately with the outer diameter of the recording material roll, and more preferably 80% to 105% of the outer diameter of the recording material roll.

Provided between the annular band-shaped flat face 32 and the rim portion 36 is a channel 34 having a substantially constant depth. With regard to the shape of the channel 34, an inner side 33 thereof runs along the outer periphery of the annular band-shaped flat face 32, and an outer side 35 thereof runs along the rim portion 36 of the flange plate. The rim portion 36 disposed on the outer side of the channel has a height that is substantially the same as that of the flat face 32.

Providing a channel region makes it possible to reduce effectively the overall height of radial ribs disposed on the back side (second side) of this region, which are provided so as to extend in the radial direction within an outermost energy absorbing zone, thereby making this outermost energy absorbing zone flexible so as to absorb almost all of an external impact.

With regard to the shape of the cross section of the channel, the angles between the inner side 33 of the channel and the base of the channel, and between the outer side 35 of the channel and the base of the channel, are preferably 90° to 135°.

The edges formed between the inclined surfaces of the channel 34 and the flat face 32 and the rim portion 36 are preferably rounded.

With regard to the shape of the outer periphery of the flange portion 30 of the roll support member 3, since it is desirable to minimize the dimensions of the case 7 for housing the roll-form recording material 1 into which the roll support members 3 have been inserted, it is preferable for it to be a shape that is basically a square, and a preferred embodiment of the present invention employs a four corner-cut square. Specific examples of the four corner-cut square are as described above.

The dimensions of the four corner-cut square flange portion 30 and, in particular, of the annular band-shaped flat portion 32, can be varied appropriately depending on the length of the recording material that is wound around the core 2.

As one embodiment, the roll support member 3 shown in FIG. 5 has the cylindrical insertion portion 20 having the extremity thereof open and a wall 23 provided therein parallel to the flange portion 30. It is preferable to provide a required number of slits 24 at the extremity of the insertion portion 20. Providing the slits 24 enables the stacking properties when the roll support members are stacked to be improved. This is explained further with reference to FIG. 7.

By engaging the insertion portion 20 of the roll support members with the hollow portion of either end of the core 2 around which the roll-form recording material 1 has been wound and making the outer peripheral face 21 of the insertion portion come into intimate contact with the inner peripheral face of the core 2, it is possible to prevent pressure from outside the package and deformation of the core as a result of vibration during transport or being dropped.

The flange portion 30 has a thickness over the whole area thereof because of the energy absorbing zone-forming concentric ribs and the radial ribs in the radial direction that intersect the concentric ribs. This is explained in detail below.

FIG. 6 is a schematic perspective view from the second side 39 (a side opposite to the flat face) of one embodiment of the roll support member of the present invention, and shows an outline of the energy absorbing zones. The energy absorbing zones illustrated here comprise a first energy absorbing zone 60, a second energy absorbing zone 61, and an outermost energy absorbing zone 62. That is, regions sandwiched by two adjacent ribs, among a first circular rib 51, a second circular rib 52, a third circular rib 54, and the outer peripheral side 37, which are disposed on the flange plate substantially concentrically, form in sequence the first, second, and outermost energy absorbing zones. The region sandwiched between the first circular rib 51 and the second circular rib 52 forms the first energy absorbing zone (60), the region sandwiched between the second circular rib (52) and the third circular rib (54) forms the second energy absorbing zone (61), and the region sandwiched between the third circular rib (54) and the outer peripheral side (37) forms the outermost energy absorbing zone (62).

Disposed in the radial direction in each of the energy absorbing zones of the flange plate are radial ribs that intersect the circular ribs. In an example illustrated in the figure, the numbers of radial ribs in the first, second, and outermost energy absorbing zones are respectively 12, 24, and 24. These radial ribs, together with two adjacent circular ribs, form a group of small spaces.

Since the small spaces in each of the energy absorbing zones are formed from a flexible material, when an external force is applied to the roll support member it is elastically deformed due to the external force, thus absorbing and damping the energy. The ease of deformation depends on the modulus of elasticity of the small spaces. The thicker the flange plate of the base face forming the small spaces, the more resilient it is to deformation, and the thicker the rib rising from the flange plate and the higher it is, the more resilient it is to deformation. Providing a slit in the rib makes it easy to deform, whereas increasing the number of radial ribs to reduce the dimensions of the small spaces makes it harder to deform. When an external force such as a drop impact is applied, the insertion portion that engages with the core suppresses deformation due to the structure of the insertion portion having high rigidity, and the farther from the insertion portion, the larger the bending stress tends to be. The roll support member 3 of the present invention is characterized in that a plurality of substantially concentric energy absorbing zones have comparatively high rigidity, the outermost energy absorbing zone is flexible, and most of the external impact is absorbed and damped by the outermost energy absorbing zone being elastically deformed, plastically deformed, or partially broken.

FIG. 7 is a schematic cross sectional perspective view along line A-A' of FIG. 6.

In FIG. 7, the outer peripheral side 37 comprises a portion formed by bending, at a substantially constant height, a peripheral portion of the flange plate 38, which includes the flat face 32, the channel 34, and the rim portion 36, toward the side opposite to the side where the insertion portion 20 is formed. The edge formed between the outer peripheral side 37 and the flange plate 38 is preferably rounded.

In FIG. 7, the first circular rib 51 is provided integrally with the flange plate 38 on the opposite side 39 of the flange plate 38 at a position substantially where the insertion portion 20 is disposed. The shape of the first circular rib 51 is preferably oval, and it is preferably eccentric with respect to the center of the flange portion 30. Furthermore, in order to enable the roll support members 3 to be stacked, the outer peripheral face 21 of the insertion portion 20 and the inner peripheral face 51*a* of the first circular rib 51 can be loosely fitted together.

The oval referred to here includes a racetrack shape in which semicircles are connected by straight lines, and a shape obtained by stretching one of perpendicular axes of a circle. The major axis is preferably longer than the minor axis by 2% to 10%, and more preferably by 2% to 5%.

In FIG. 7, provided within the first circular rib 51 are a cylindrical rib 56, which is disposed on the wall 23 and is concentric with the insertion portion, and four radial ribs 57 connecting the cylindrical rib 56 to the first circular rib 51 in the radial direction.

The cylindrical rib 56 and the radial ribs 57 are high, and because of the internal structure of these ribs, the entire insertion portion 20 is connected to the flange portion 30 with extremely high rigidity. Because of this high structural rigidity, even when the recording material package is dropped and an impact is imposed on the roll support member, it is possible to completely prevent damage to the insertion portion 20.

In FIG. 7, four radial ribs 53 are disposed so as to extend from the cylindrical rib 56 to the outer peripheral side 37 and on the way intersect with the first, second, and third circular ribs. The first energy absorbing zone has a total of twelve radial ribs including radial ribs disposed therebetween, and the second energy absorbing zone and the outermost energy absorbing zone have a total of twenty four radial ribs including radial ribs disposed therebetween.

The radial ribs 53 are provided integrally with the flange plate 38 forming the flange portion, the first circular rib 51, the second circular rib 52, the third circular rib 54, and the outer peripheral side 37.

Furthermore, radial ribs 55 can be disposed in a radial direction with the cylindrical rib 56 as the center so as to connect the second circular rib 52 to the outer peripheral side 37. The radial ribs 55 are provided integrally with the flange plate 38 forming the flange portion, the second circular rib 52, the third circular rib 54, and the outer peripheral side 37.

In the present invention, as shown in FIG. 7, it is preferable to provide indentations in the radial ribs 53 and the radial ribs 55, which are connected to the outer peripheral side of the flange portion. In FIG. 7, the indentations 58 are indentations provided in the radial ribs 53 and the radial ribs 55, which provide a connection between the outer peripheral side 37 of the flange portion 30 and the third circular rib 54. It is preferable for edges of the indentations 58 provided in the radial ribs 53 and 55 to be rounded.

In the present invention, it is also possible to provide a circular or radial rib other than the above-mentioned ribs.

The height of the outer peripheral side 37 of the flange portion 30 is no greater than the heights of the ribs forming the energy absorbing zone, and the height of the outer peripheral side can be lower than the heights of the ribs. It is preferable for the height of the outer peripheral side to be substantially equal to the height of the longest rib of the energy absorbing zone provided on the inside.

Figure 9:
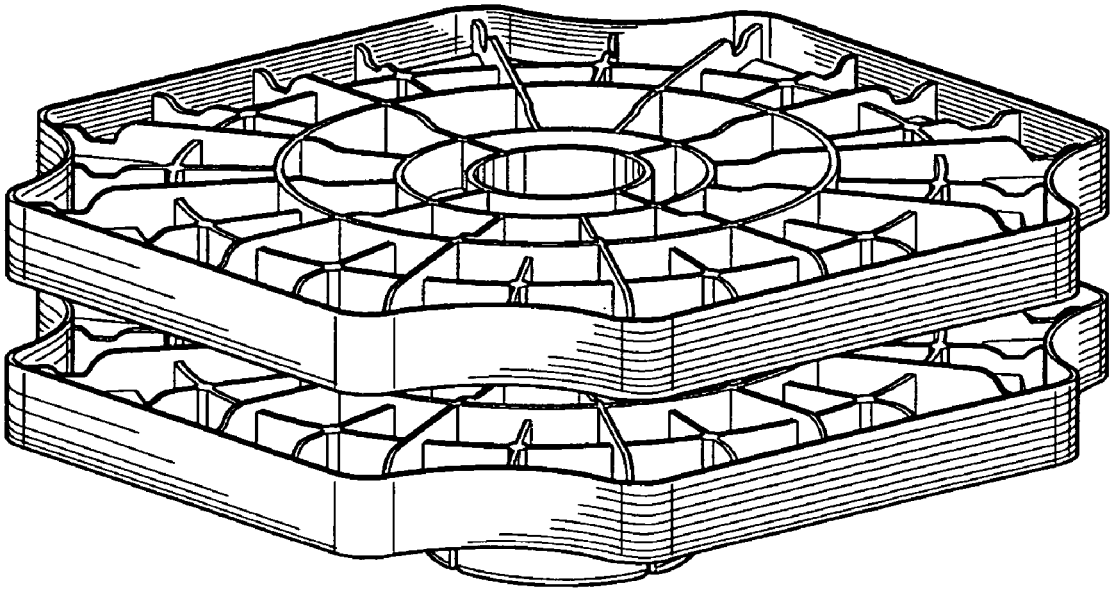
FIG. 9 is a schematic perspective view when the roll support members of the embodiment of the present invention are stacked together.

In FIG. 7, the slits 24 at the extremity of the insertion portion 20 are provided at a position corresponding to the radial ribs 57, and when the roll support members 3 are stacked and stored, it is easy to carry out positioning for stacking, and it is effective in improving the stacking properties. FIG. 9 shows a schematic perspective view when the roll support members as one embodiment of the present invention are stacked together.

Unlike the embodiment shown in FIG. 5 to 7, the extremity of the insertion portion 20 can be closed. When the extremity of the insertion portion is closed, in order to make insertion into the hollow portion of the core easy and prevent any damage, it is preferable for a rim portion of a flat portion at the extremity of the insertion portion to have a shape in which the corner is cut off. The corner-cut rim portion preferably has a length of 1 to 6 mm. If it is less than 1 mm, it is difficult to carry out the insertion into the hollow portion of the core, and if it exceeds 6 mm, the cylindrical section that is in intimate contact with the inner peripheral part of the core is short, and the contact is unstable, which is undesirable. It is preferable for the corner formed between the flat portion at the extremity of the insertion portion and the rim portion of the flat portion at the extremity, and the corner formed between the rim portion of the flat portion at the extremity and the outer peripheral face of the insertion portion to be rounded.

When the extremity of the insertion portion is closed, the height of the cylindrical rib 56 and the radial ribs 57 can be the same as that of the first circular rib 51, but in order to increase the overlap when stacking and storing the roll support members 1 with the insertion portions 20 fitted together, the height of the cylindrical rib 56 and the radial ribs 57 can be shorter than that of the first circular rib 51.

In the same way as in the case when the extremity of the insertion portion is open, in the case in which extremity of the insertion portion is closed, slits 24 can be provided in the outer periphery of the extremity of the insertion portion. The slits are preferably provided at positions where they can be engaged with the radial ribs 57.

Figure 8:
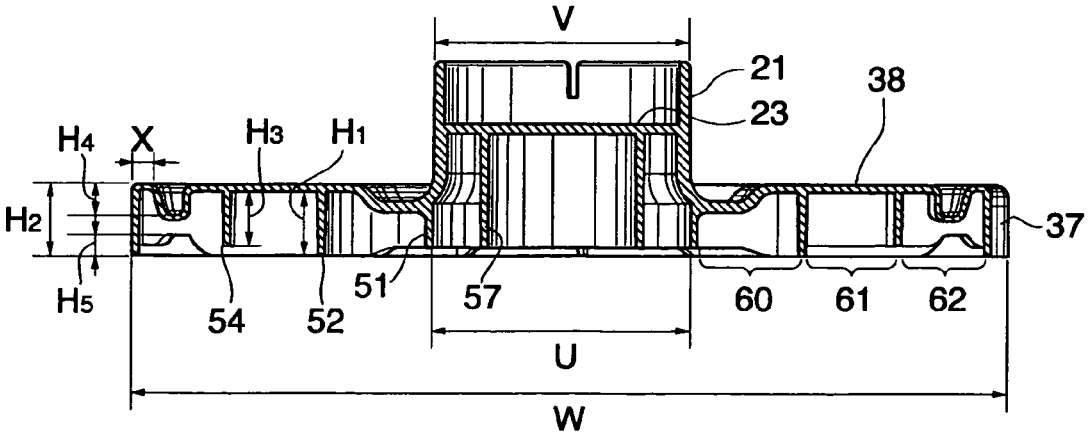
FIG. 8 is a schematic cross sectional view along line A-A' of FIG. 6.

FIG. 8 is a schematic cross sectional view along line A-A' of FIG. 6.

As shown in FIG. 8, the flange portion 30 has the plurality of concentric energy absorbing zones and the outermost energy absorbing zone. It has the first energy absorbing zone 60 comprising the first circular rib 51, the second circular rib 52, and the flange plate 38, the second energy absorbing zone 61 comprising the second circular rib 52, the third circular rib 54, and the flange plate 38, and the outermost energy absorbing zone 62 comprising the outer peripheral side 37, the third circular rib 54, and the flange plate 38.

In another embodiment of the present invention, in addition to the first energy absorbing zone, the second energy absorbing zone, and the outermost energy absorbing zone, it can have additionally third, fourth, etc. substantially concentric energy absorbing zones.

The first energy absorbing zone 60 controls the basic flexibility of the insertion portion 20. The dimensions of the energy absorbing zone 60 are controlled by the position of the second circular rib 52, which determines the flexibility thereof. If the diameter of the second circular rib 52 is too large, the first energy absorbing zone 60 becomes too large and the flexibility is too high, the insertion portion 20 is excessively bent by a load, and when a sideways or upward impact is applied, the roll-form recording material 1 might come into contact with a side wall portion of the case 7. When the roll-form recording material 1 receives an impact and comes into contact with a side face of the case 7, the roll-form recording material 1 immediately experiences a counter impact force (reaction force), and this reaction force might cause permanent deformation in the core 2. In the present invention, with regard to other main factors that influence the flexibility of the flange plate 38, there are the thickness of the cross section of the flange plate 38, and the dynamic modulus of elasticity, etc. of a material forming the flange plate 38.

The second energy absorbing zone 61 and the outermost energy absorbing zone 62 are divided by the plurality of radial ribs. The plurality of radial ribs have the function of absorbing energy from the outer peripheral side 37. This plurality of radial ribs is designed so that energy is damped (absorbed) by bending when an excess impact is applied thereto. When the rigidity of this plurality of radial ribs is too high, all of the distortion energy from the case 7 is transmitted to the first energy absorbing zone 60. In contrast, if the rigidity of this plurality of radial ribs too low, they bend so as to draw in the outer peripheral side 37 even with a very light impact load. Moreover, there is the possibility that the flange plate 38 might break.

In FIG. 8, the outer diameter V of the insertion portion 20 is constant throughout the insertion portion except for the part in which the depression 31 is provided in the part where the insertion portion 20 and the flange portion 30 intersect. The outer diameter V varies depending on the inner diameter of the core 2 used when preparing a package, but it is preferably smaller than the inner diameter of the core 2 by a value in the range of 0.1 to 3 mm. When it is smaller by 0.1 mm or more, it is easy to insert the insertion portion 20 into the hollow portion of the core.

In FIG. 8, the inner diameter U of the first circular rib 51 is preferably larger than the outer diameter V of the insertion portion 20 by 0.1% to 10%, and more preferably 0.5% to 8%. When it is in the above-mentioned range, stacking with the insertion portion 20 in a state in which they are fitted together with play is easy, and the outer peripheral face 21 of the insertion portion is less susceptible to being scratched. When stacked, housed in a case, and returned, the outer peripheral face 21 of the insertion portion does not collide with the inner peripheral face 51*a* of the first circular rib 51 due to vibration while transporting, handling, etc., and the outer peripheral face 21 of the insertion portion is less susceptible to being scratched and recycling is easy, which is preferable.

The distance W between two opposite sides of the square shown in FIG. 8 is preferably 120 to 190 mm.

The width X of the rim portion 36 of the flange plate is preferably 3 to 10 mm.

In the present invention, the height $H_1$ of the second circular rib 52 is preferably 5 to 40 mm, and more preferably 8 to 25 mm. When it is in the above-mentioned range, the strength can be ensured, and the cost remains unchanged, which is preferable.

In the present invention, the height $H_2$ of the outer peripheral side 37 is no greater than the height $H_1$ of the second circular rib 52. That is, the height $H_2$ of the outer peripheral side is the same as the height $H_1$ of the second circular rib 52, or the height $H_2$ of the outer peripheral side is less than the height $H_1$ of second circular rib 52. The height $H_2$ of the outer peripheral side is preferably 50% to 95% of the height $H_1$ of the rib, and more preferably 60% to 90%. When the rib is higher than the outer peripheral side 37, if it is dropped from a direction oblique to the rib side of the flange portion 30, the case 7 and the rib receive an impact prior to the outer peripheral side 37, and the case 7 and the rib deform so as to absorb the impact, thereby preventing any damage to the outer peripheral side 37, which is preferable.

The heights of the first circular rib 51 and the third circular rib 54 are preferably no more than the height $H_2$ of the outer peripheral side 37. The height $H_3$ of the third circular rib 54 is preferably 50 to 100% of the height $H_2$ of the outer peripheral side 37, and more preferably 70 to 100%.

The heights of the radial ribs 53 and 55 disposed radially with the cylindrical rib 56 as the center so as to provide connections between the cylindrical ribs and the outer peripheral side 37 are no greater than the heights of the cylindrical ribs and the outer peripheral side 37.

The depth $H_4$ of the channel 34 is no greater than the height $H_2$ of the outer peripheral side of the flange portion 30, and is preferably 50 to 80% of the height $H_2$ of the outer peripheral side.

The depth $H_5$ of the slit provided in the rib connected to the outer peripheral side of the flange portion is preferably 10 to 60% of the height $H_2$ of the outer peripheral side.

In the present invention, the thicknesses of the flange plate 38 forming the flange portion, the outer peripheral side 37, and the ribs are preferably 0.5 to 3.0 mm. The thickness of a material forming the insertion portion 20 is preferably 0.5 to 3.0 mm. The roll support member of the present invention, which has excellent impact resistance, is resistant to damage even when it is formed from the above-mentioned thin material.

In a preferred embodiment of the roll support member of the present invention, the inner diameter of the first circular rib 51 is preferably determined by its fit with the outer peripheral face 21 of the insertion portion 20, the diameter of the third circular rib 54 is preferably smaller than the outer diameter of the annular band-shaped flat face 32 by 5% to 20%, and the second circular rib 52 is preferably disposed so as to be in a position substantially midway between the first circular rib 51 and the third circular rib. The outer diameter of the annular band-shaped flat face 32 is preferably 80% to 105% of the outer diameter of the recording material roll. With regard to the relative height of the radial ribs in the energy absorbing zones, relative to the second circular rib, which is defined as 100, the height of the first circular rib is preferably 70 to 100, the height of the third circular rib is 50 to 100, and the height of the outer peripheral side is 50 to 100.

The number of radial ribs in the first energy absorbing zone is preferably 4 to 8, the number of radial ribs provided in the second energy absorbing zone is preferably 1 to 4 times the number of radial ribs in the first energy absorbing zone, and more preferably 1 to 2 times, and the number of radial ribs in the outermost energy absorbing zone, which is surrounded by the outer peripheral side of the flange portion, is preferably 1 to 4 times the number of radial ribs provided in the energy absorbing zone immediately on the inside thereof, and more preferably 1 to 2 times.

Another embodiment of the present invention is explained below with reference to FIGS. 10 and 11.

Figure 10:
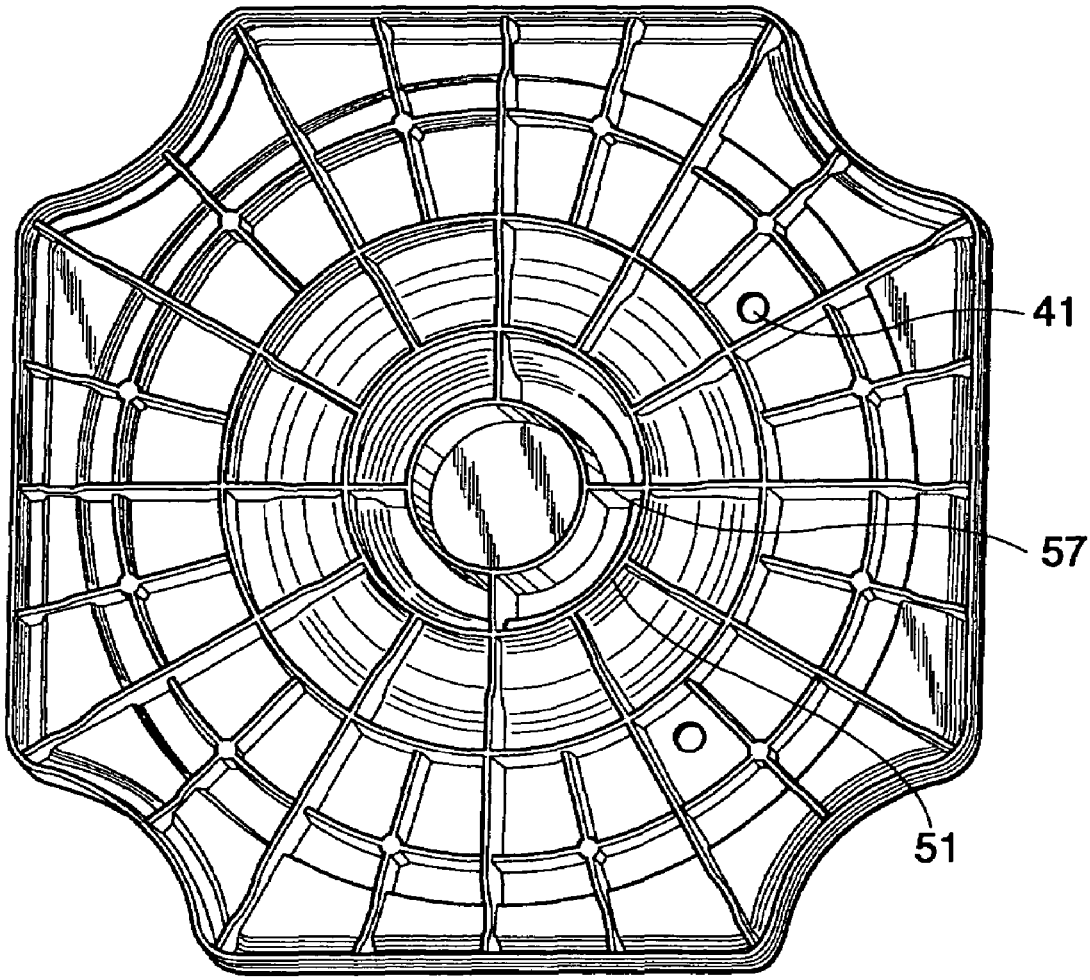
FIG. 10 is a schematic perspective view from the second side (opposite side) of the roll support member of another embodiment of the present invention.
Figure 11:
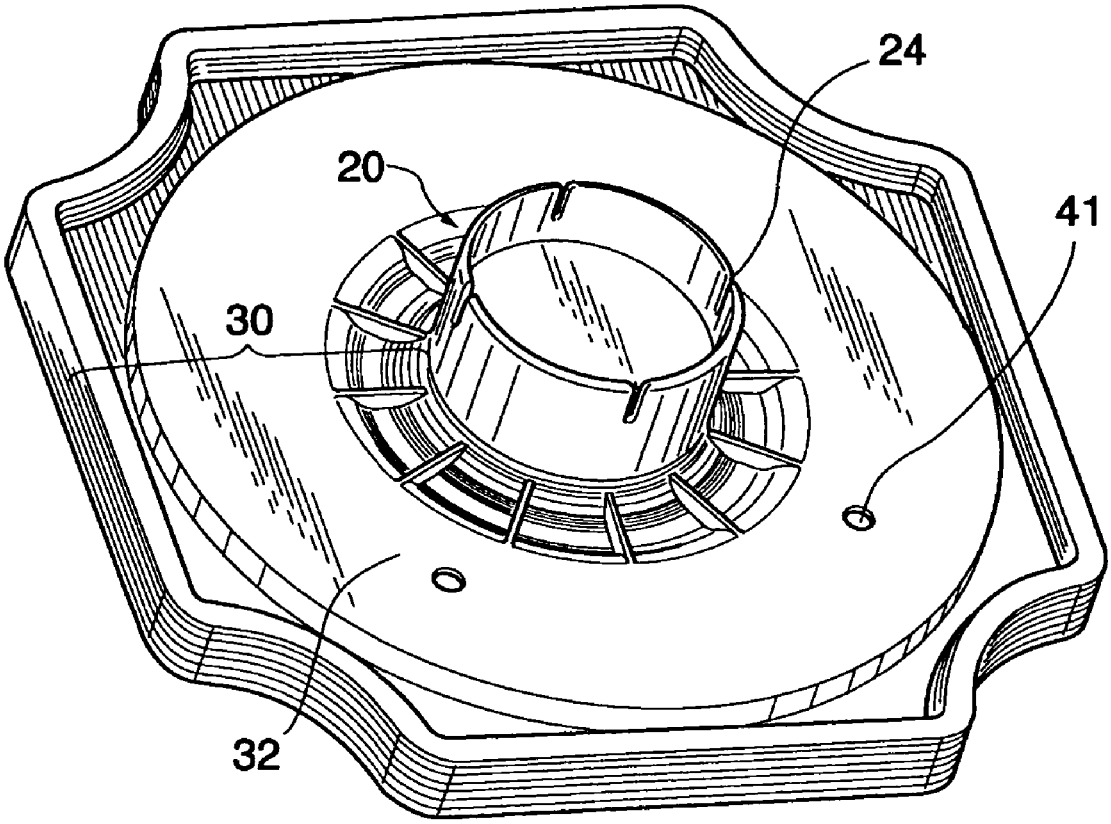
FIG. 11 is a schematic perspective view from the first side (flat face) of a roll support member of said another embodiment of the present invention

FIG. 10 is a schematic perspective view from the second side (opposite side) of said another embodiment of the roll support member of the present invention. FIG. 11 is a schematic perspective view from the first side (flat face) of said another embodiment of the roll support member of the present invention A hole 41 is opened in a flat face 32 of a flange portion 30 at a predetermined position relative to a first circular rib 51. For example, it is a position that is separated from the first circular rib 51 by a predetermined distance in the radial direction. The number of holes 41 is not particularly limited, and it may be one or two or more as necessary. For example, two types of products can be differentiated by whether there is one hole or not, and four types of products can be differentiated by whether there are two holes or not, thereby imparting product information. Different types of roll support members whose shapes are only slightly different from each other can thereby be easily discriminated.

The roll support members of the present invention can be stacked concentrically with high precision by engagement of the slit 24 at the extremity of the insertion portion 20 with the ribs 57. The hole 41 of the flange portion 30 is positioned with a predetermined relationship relative to the oval of the first circular rib 51. It is therefore easy to detect the hole 41 of the flange portion 30 by detecting along the longitudinal direction of the oval of the first circular rib 51 from the side of the flange portion 30 at the top of the stack. For example, after detecting along the longitudinal direction of the oval by an image scanner, the position of the hole 41 of the flange portion 30 is detected, thus allowing the information to be read off automatically. Furthermore, after attaching a jig to the oval of the first circular rib 51 and detecting along the longitudinal direction, the hole 41 of the flange portion 30 can also be detected.

As hereinbefore described, with regard to the roll support member of the present invention, the flange portion thereof is a four corner-cut square, and the height of the outer peripheral side of the flange portion is the same as or preferably less than the height of the rib. Therefore, even when the recording material package is dropped in a state in which a corner or a side of the case is exposed to an impact, since the roll support member is positioned so as to avoid the corners or the sides of the case, the case and the ribs absorb the impact first, thus providing an arrangement in which the roll support member is resistant to damage. Furthermore, the roll support member of the present invention is provided with an energy absorbing zone for absorbing an impact on the second side, which is opposite to the side from which the insertion portion of the flange portion projects. In particular, by adjusting the height of the ribs in the outermost energy absorbing zone, it is possible to absorb the impact of being dropped even using a material having low strength.

Furthermore, since the roll support member of the present invention is formed by integrally molding the flange portion and the insertion portion, the moldability is excellent.

In addition, since the flange portion has at a fixed position a hole that can be read automatically by a production machine, it is possible to provide a roll support member that enables discrimination of product types to be carried out automatically in multi-product production.

With regard to a recording material package employing the roll support member of the present invention, the roll-form recording material 1 can be housed without using flanges at its end faces. It is also possible to use flanges, and in this case a light-shielding, moisture-proof material of a light-shielding flange, a light-shielding sheet, etc. is not particularly limited as long as it does not affect the photographic performance and has the function of shielding light and preventing moisture from being entrapped and, for example, light-shielding, moisture-proof materials described in JP-A-6-95302 and JP-A-8-179473 can be used.

A material of the roll support member of the present invention is not particularly limited, and examples of the material that can be used include a thermoplastic resin such as PE, PP, or PS, a biodegradable resin, and a mixture of paper or wood, etc. (0 to 95 wt %, preferably 0 to 75 wt %, and more preferably 1 to 51 wt %) and a thermoplastic resin (PE, PP, PS; a biodegradable resin such as polylactic acid) (in the present invention a mixture having at least 51 wt % of a paper component is also called a 'paper resin').

The paper resin is a mixture of a paper and a resin, and the paper resin is a composition comprising as a ratio by weight at least 51% of a paper component such as wastepaper and at most 49% of a resin component. Since it can be disposed of in the same manner as for paper, it is preferable as a material for the roll-form support member, and it can also be used as the core or as a cushioning material. In this case, since moldings made from the paper resin can be disposed of in the same manner as for the paper component of a packaging material, it is unnecessary to classify them for disposal. With regard to the paper resin used for the roll support member of the present invention, it is preferable to use a mixture containing 51 to 70 wt % of the paper component and 49 to 30 wt % of the resin component. If the content of the paper component is less than 51 wt %, it cannot be disposed of as paper. If the content of the thermoplastic resin component is less than 30 wt %, the strength of the paper resin is insufficient. With regard to the resin component, there can be cited as examples polyethylene, polypropylene, polystyrene, a biodegradable resin such as polylactic acid, etc.

A thermoplastic resin having a Charpy impact strength of 6.0 kJ/m$^2$ or higher, and a nominal tensile strain at break of 200% or higher can preferably be used. Examples of the thermoplastic resin that can be used in the roll support member of the present invention include polypropylene, high-density polyethylene, low-density polyethylene, and straight-chain low-density polyethylene. Representative examples of commercial products of these thermoplastic resins are listed below.

(1) Polypropylene

BC8, BC4L, and BC4LA manufactured by Japan Polychem Corp.,

J466HP, J762HP, J2021GR, and J3021GR manufactured by Idemitsu Petrochemical, (2) High-density Polyethylene HJ490, HJ580, HJ560, and HJ360 manufactured by Japan Polychem Corp., (3) Low-density Polyethylene LE520H, LF660H, LF542M, LC522, LC500, LC621, and LJ800 manufactured by Japan Polychem Corp., (4) Straight-chain Low-density Polyethylene UJ960, UJ370, UJ580, UJ480, UJ990, and UJ790 manufactured by Idemitsu Petrochemical The paper material used for the case is not particularly limited, but corrugated cardboard is preferable from the viewpoint of handling, ease of production, and strength. With regard to the corrugated cardboard, general A flute to E flute double-faced corrugated cardboard, and double-walled corrugated cardboard such as those described in 'Saishin Kami Kako Binran (Current Paper Processing Handbook)' edited by The Paper Processing Handbook Committee (K.K. Tech Times, 1988) are preferably used, but there are no particular restrictions. It is selected appropriately according to the dimensions of the roll-form recording material.

In accordance with the present invention, a roll support member can be obtained with low cost, the roll support member having high resistance to drop impact even when a thin, low strength material is used. Furthermore, it can provide a roll support member that enables discrimination of the product type to be carried out automatically by means of a hole, etc. provided in the flange plate.

Moreover, a roll support member and a recording material package that are resistant to a drop impact even when no light-shielding flange is used at the end face of the roll-form recording material can be obtained.

EXAMPLES

Examples are illustrated below, but the present invention is not limited thereto.

Example 1, Comparative Example 1 to 3

The roll support members shown in Table 1 were prepared using a paper resin. Example 1 is the roll support member shown in FIGS. 2 to 4.

The paper resin used was a mixture containing 68 wt % of photographic printing paper and a total of 32 wt % of a polypropylene resin and an additive. The polypropylene used was BC4L manufactured by Japan Polychem Corp.

TABLE 1

| | Shape of flange portion | Molding of flange portion and insertion portion | Rib of flange portion | Relationship between outer peripheral face and rib heights | Rib within insertion portion | Notch in flange portion rib |
|---|---|---|---|---|---|---|
| Comp. Example 1 | Square | Integral molding | Present | Same | Absent | Absent |
| Comp. Example 2 | Square | Integral molding | Present | Same | Present | Absent |
| Comp. Example 3 | Square | Integral molding | Present | Outer peripheral face is lower than rib | Absent | Present |
| Example 1 | Four corner-cut square | Integral molding | Present | Outer peripheral face is lower than rib | Present | Present |

The recording material was packaged as shown in FIG. 1 using the roll support members prepared above. This package was subjected to a drop test in accordance with JIS Z0202, and the strength of the roll support member was evaluated.

Method and Results of Drop Test

The recording material package was dropped from a position at a height of 400 mm, and the state of damage of the roll support member was inspected. The results are given in Table 2.

The recording material package of Example 1 had a higher resistance to the drop impact than the recording material packages of Comparative Examples 1 to 3, and even the roll support member made of paper resin gave sufficient strength.

TABLE 2

| | Corner | Short side | Long side | Side face | Upper and lower faces |
|---|---|---|---|---|---|
| Comp. Example 1 | Poor | Poor | Poor | Poor | Good |
| Comp. Example 2 | Poor | Poor | Poor | Good | Good |
| Comp. Example 3 | Good | Good | Poor | Poor | Good |
| Example 1 | Good | Good | Good | Good | Good |

Poor: the roll support member was damaged.
Fair: the roll support member was deformed but could be used.
Good: neither damage or deformation was observed in the roll support member.

Example 2

Figure 12:
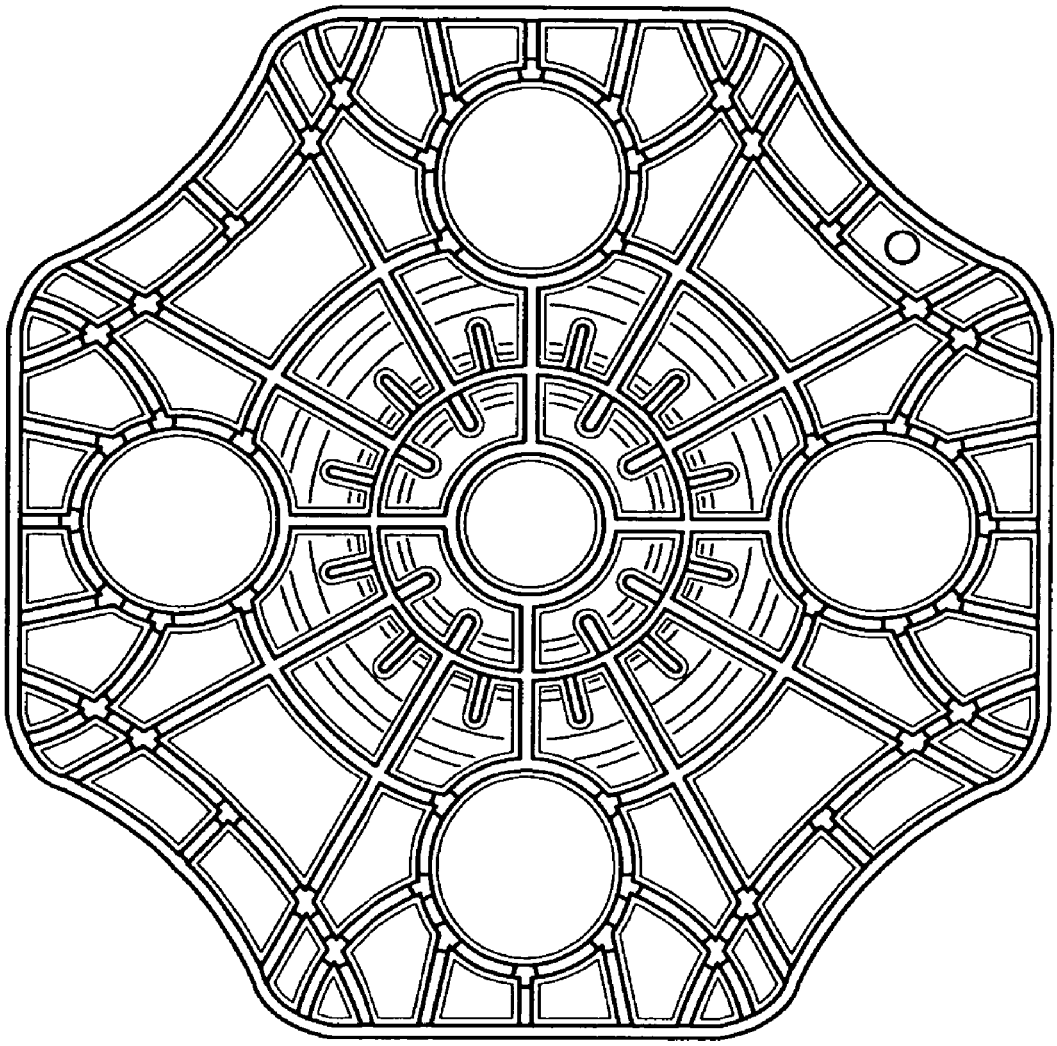
FIG. 12 is a schematic view from the second side (opposite side) of a roll support member prepared in Example 2.
Figure 13:
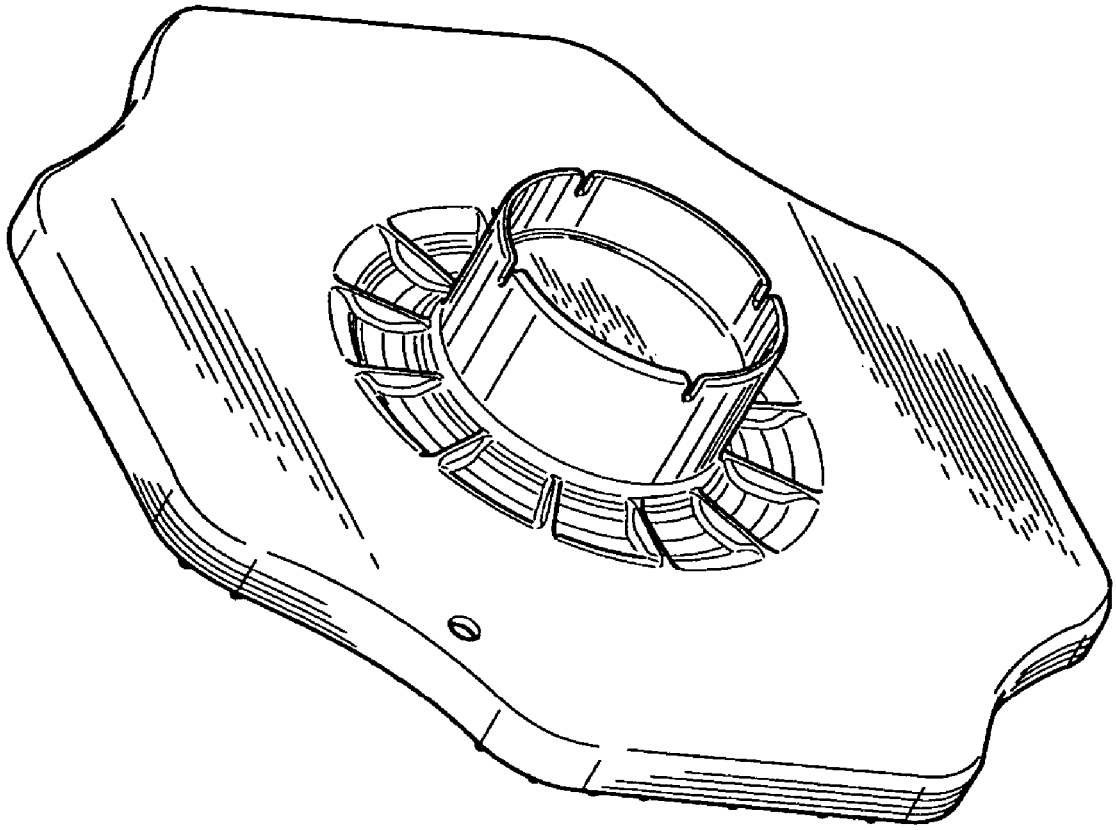
FIG. 13 is a schematic perspective view from the first side (flat face) of the roll support member prepared in Example 2.

The roll support member shown in FIG. 12 and FIG. 13 was prepared as in Example 1. When a recording material package employing this was subjected to a drop test, it was found that the resistance to the drop impact was as high as in Example 1, and the roll support member made of paper resin could give sufficient strength.

Examples 3 to 5

Roll support members having the same structure as that of the roll support member shown in FIGS. 2 to 6 were prepared using a PP resin (J-762HP manufactured by Idemitsu Petrochemical) containing 20 wt % of paper except that combinations of the presence and absence of a channel in the flat face of the flange portion and a slit in the ribs were as shown in Table 3.

The depth of the channel of the roll support member was 6 mm, and the height of the flange portion outer peripheral side was 14 mm, which was the same as the height of the ribs of the energy absorbing zone.

The recording material was packaged as shown in FIG. 1 using the roll support members prepared above without using a light-shielding flange. The recording material was a printing paper.

This package was subjected to a drop test, and the strength of the roll support member was evaluated.

Comparative Example 4

Roll support members having a circular flange at one end of a cylindrical shaft were used in combination. The cylindrical shaft was formed using PP.

As the flange portion, two sheets of square cardboard having a size corresponding to the side face of the case were superimposed, and a circular hole having a size that was the same as that of the cylindrical shaft of the roll support member prepared above was opened.

The cylindrical shaft of the roll support member was inserted in turn into the cardboard flange portion and the core of the roll-form recording material, they were housed together in the case, and the recording material was thus packaged. The recording material was the same type of recording material as that used in Example 3.

This package was subjected to a drop test, and the strength of the roll support member was evaluated.

TABLE 3

| | Channel on flat face side of flange portion | Slit in rib of flange portion |
|---|---|---|
| Example 3 | Present | Absent |
| Example 4 | Absent | Present |
| Example 5 | Present | Present |
| Comparative Example 4 | — | — |

Drop Test

The recording material package was dropped from positions at heights of 20, 30, 40, 50, 70, and 100 cm, and the state of damage of the recording material was inspected. The results are given in Table 4.

TABLE 4

| | 20 cm | 30 cm | 40 cm | 50 cm | 70 cm | 100 cm |
|---|---|---|---|---|---|---|
| Example 3 | Good | Good | Good | Good | Poor | Poor |
| Example 4 | Good | Good | Good | Poor | Poor | Poor |
| Example 5 | Good | Good | Good | Good | Good | Poor |
| Comparative Example 4 | Good | Fair | Poor | Poor | Poor | Poor |

Good: no damage to the product.
Fair: slight damage to the product.
Poor: serious damage to the product.

The recording material packages of Examples 3 to 5 had a higher resistance to the drop impact than the recording material package of Comparative Example 4, and gave sufficient strength.

What is claimed is:

1. A roll support member that is used for suspending in a packaging case a roll-form recording material wound around a core, the roll support member comprising:

a four corner-cut square flange portion having a thickness; and an insertion portion that projects cylindrically from substantially the center of the flange portion and is inserted into one end of the core;

the flange portion and the insertion portion being formed integrally;

the side of the flange portion from which the insertion portion projects being a flat face;

the side of the flange portion opposite to the flat face being provided with a plurality of concentric ribs forming in sequence a plurality of energy absorbing space zones disposed substantially concentrically on the flange portion; and the outer peripheral side of the flange portion having a height that is no greater than the height of the ribs wherein the flat face is an annular band shape, the outer periphery of the annular band-shaped flat face corresponds substantially to the outermost periphery of the roll-form recording material, and a channel is provided between the annular band-shaped flat face and the flange portion outer peripheral side.

2. The roll support member according to claim 1, wherein the ribs have notches.

3. The roll support member according to claim 1, wherein the insertion portion forms a hollow inner portion, and the hollow inner portion has therein a rib disposed in a cylindrical shape that is substantially concentric with the insertion portion and radial ribs disposed so as to provide a connection between the substantially concentric cylindrical rib and the face of the insertion portion on the hollow inner portion side.

4. The roll support member according to claim 1, wherein the ribs connected to the outer peripheral side of the flange portion are provided with notches.

5. The roll support member according to claim 1, wherein the insertion portion comprises:

a wall provided within the insertion portion parallel to the flange portion;

a notch at the extremity of the insertion portion; and a rib disposed in a cylindrical shape that is substantially concentric with the insertion portion within a hollow inner portion formed by the insertion portion and the wall, and a radial rib disposed so as to provide a connection between the substantially concentric cylindrical rib and the face of the insertion portion on the hollow inner portion side;

the radial rib being provided so as to engage with the notch at the extremity of the insertion portion when the roll support members are stacked;

an oval rib being provided on the side of the flange portion opposite to the flat face, the oval rib and the insertion portion fitting together when the roll support members are stacked; and a hole being opened in the flange portion at a predetermined position in relation to the oval rib.

6. A recording material package in which a roll-form recording material is suspended and supported by the roll support member according to claim 1 and housed in a rectangular parallelepiped housing.

7. The recording material package according to claim 6, wherein the roll-form recording material that is housed has no flange on either end face thereof.

* * * * *